US011660889B2

(12) United States Patent
Takei et al.

(10) Patent No.: US 11,660,889 B2
(45) Date of Patent: May 30, 2023

(54) PRINTING APPARATUS

(71) Applicant: SEIKO EPSON CORPORATION, Tokyo (JP)

(72) Inventors: Hiroaki Takei, Matsumoto (JP); Yasushi Yajima, Minowa-machi (JP)

(73) Assignee: Seiko Epson Corporation, Tokyo (JP)

( * ) Notice: Subject to any disclaimer, the term of this patent is extended or adjusted under 35 U.S.C. 154(b) by 37 days.

(21) Appl. No.: 17/178,732

(22) Filed: Feb. 18, 2021

(65) Prior Publication Data

US 2021/0260898 A1 Aug. 26, 2021

(30) Foreign Application Priority Data

Feb. 21, 2020 (JP) ..... JP2020-027879

(51) Int. Cl.

| | |
|---|---|
| ***B41J 2/01*** | (2006.01) |
| ***B41J 29/02*** | (2006.01) |
| ***B41J 11/66*** | (2006.01) |
| ***B41J 13/10*** | (2006.01) |
| ***B41J 15/04*** | (2006.01) |

(52) U.S. Cl.

CPC ..... *B41J 29/02* (2013.01); *B41J 11/66* (2013.01); *B41J 13/10* (2013.01); *B41J 15/04* (2013.01); *B41J 2/01* (2013.01)

(58) Field of Classification Search

None

See application file for complete search history.

(56) References Cited

U.S. PATENT DOCUMENTS

2010/0221058 A1 9/2010 Inoue
2019/0030925 A1* 1/2019 Takahashi ..... B41J 15/042

FOREIGN PATENT DOCUMENTS

| | | | |
|---|---|---|---|
| JP | 2004231376 A | * | 8/2004 |
| JP | 2010-201679 | | 9/2010 |
| JP | 2010-241029 | | 10/2010 |
| JP | 2011005831 A | * | 1/2011 |
| JP | 2011-056887 | | 3/2011 |
| JP | 2012-161943 | | 8/2012 |

* cited by examiner

*Primary Examiner* — Erica S Lin
*Assistant Examiner* — Tracey M McMillion
(74) *Attorney, Agent, or Firm* — Workman Nydegger

(57) ABSTRACT

A printing apparatus including a roll paper accommodating unit configured to accommodate roll paper, a single sheet paper accommodating unit configured to accommodate single sheet paper, a printing unit configured to perform printing on the roll paper fed from the roll paper accommodating unit, and to perform printing on the single sheet paper fed from the single sheet paper accommodating unit, and a main body frame that supports the single sheet paper accommodating unit and the roll paper accommodating unit, in which the roll paper accommodating unit and the single sheet paper accommodating unit are located in ranges, in a front-back direction of the printing apparatus, overlapping a range in which the printing unit is present, and are located downward of the printing unit with respect to a vertical direction, and the roll paper accommodating unit and the single sheet paper accommodating unit are movable frontward of the printing apparatus.

5 Claims, 3 Drawing Sheets

PRINTING APPARATUS

The present application is based on, and claims priority from JP Application Serial Number 2020-027879, filed Feb. 21, 2020, the disclosure of which is hereby incorporated by reference herein in its entirety.

BACKGROUND

1. Technical Field

The disclosure relates to a printing apparatus.

2. Related Art

In the related art, there is known a printing apparatus in which roll paper accommodated below a printing unit, and fan fold paper that is a printing medium other than the roll paper can be selected to be used, as described in JP 2010-201679 A.

Unfortunately, in the printing apparatus described in JP 2010-201679 A, an insertion port through which the printing medium other than the roll paper is inserted is provided at a rear portion of the apparatus, and the printing medium needs to be placed on a backside of the apparatus. That is, for an installation of the printing apparatus, a placement space for placing the printing medium and a work space for placing the printing medium on the backside are necessary in addition to a size of the apparatus, and there is an issue in that an installation space for installing the printing apparatus increases.

SUMMARY

A printing apparatus including a roll paper accommodating unit configured to accommodate roll paper, a single sheet paper accommodating unit configured to accommodate single sheet paper, a printing unit configured to perform printing on the roll paper fed from the roll paper accommodating unit, and to perform printing on the single sheet paper fed from the single sheet paper accommodating unit, and a main body frame that supports the single sheet paper accommodating unit and the roll paper accommodating unit, in which the roll paper accommodating unit and the single sheet paper accommodating unit are located in ranges, in a front-back direction of the printing apparatus, overlapping a range in which the printing unit is present, and are located downward of the printing unit with respect to a vertical direction, and the roll paper accommodating unit and the single sheet paper accommodating unit are movable frontward of the printing apparatus.

DESCRIPTION OF EXEMPLARY EMBODIMENTS

First, a schematic configuration of a printing apparatus 11 according to an embodiment will be described. The printing apparatus 11 is an inkjet type printer configured to discharge ink to perform printing on a printing medium, for example. In the coordinates appended to the figures, three virtual axes orthogonal to one another are designated as an X axis, a Y axis, and a Z axis on the assumption that the printing apparatus 11 is placed on a horizontal face. The Y axis is an axis that is parallel to a front-back direction of the printing apparatus 11, and a leading end side of an arrow indicating the Y axis is designated as "front". The X axis is an axis that is parallel to a left-right direction of the printing apparatus 11, and a leading end side of an arrow indicating the X axis is designated as "right". The Z axis is a virtual axis that is parallel to a vertical direction, and a leading end side of an arrow indicating the Z axis is designated as "down".

Figure 1:
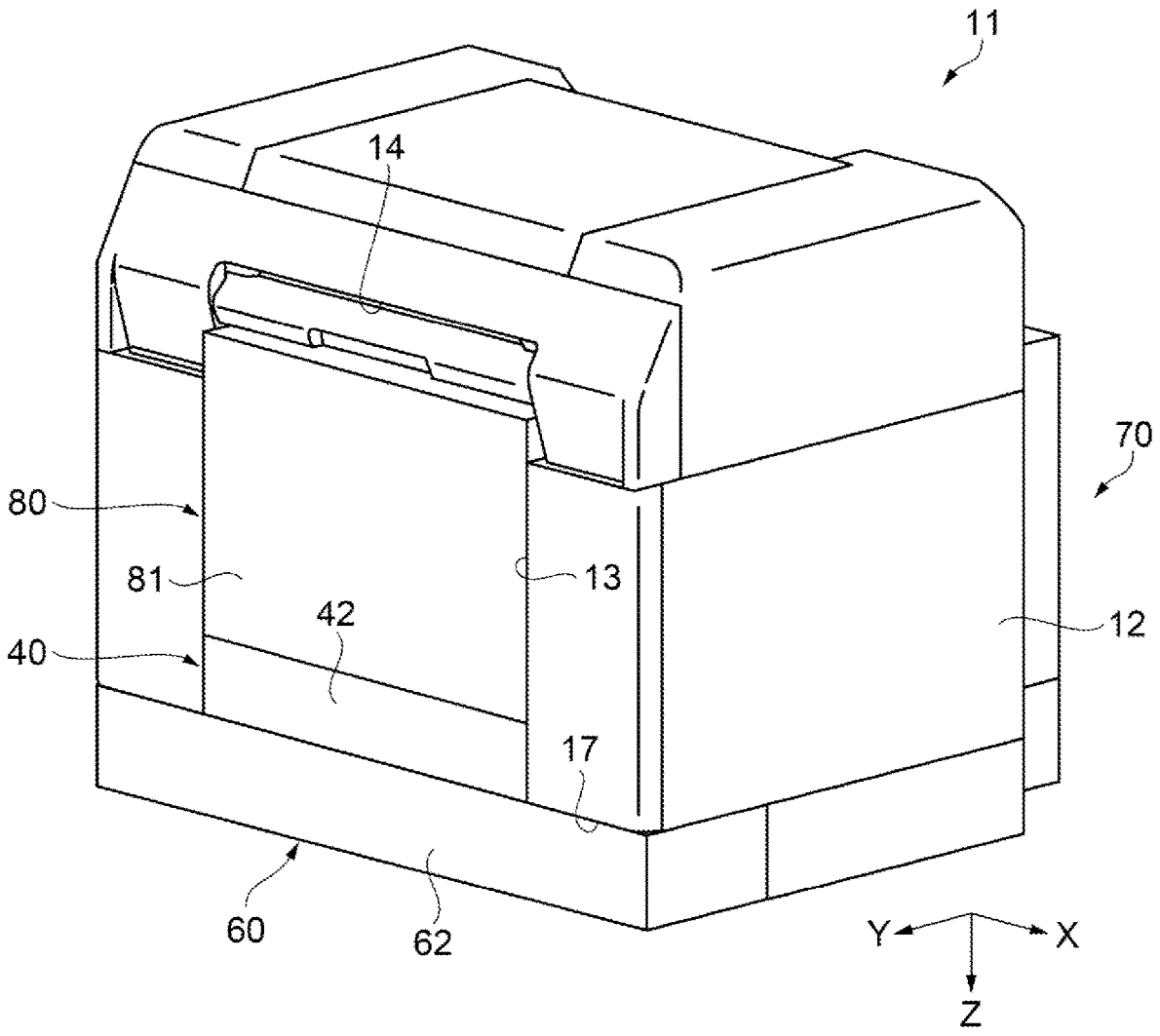
FIG. 1 is a perspective view illustrating an external appearance of a printing apparatus according to an embodiment.
Figure 2:
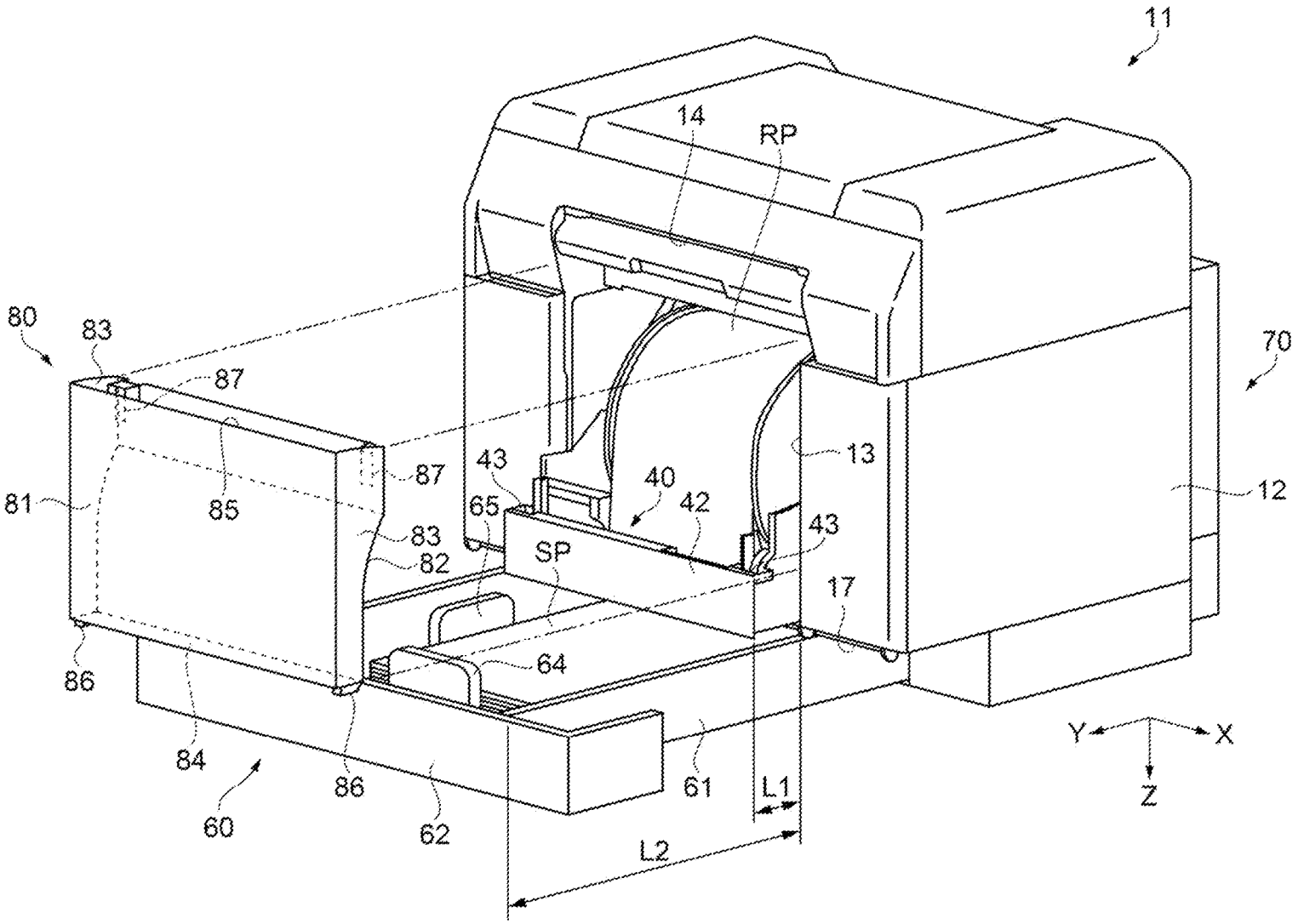
FIG. 2 is a perspective view illustrating a state where a roll paper accommodating unit and a single sheet paper accommodating unit are moved frontward.
Figure 3:
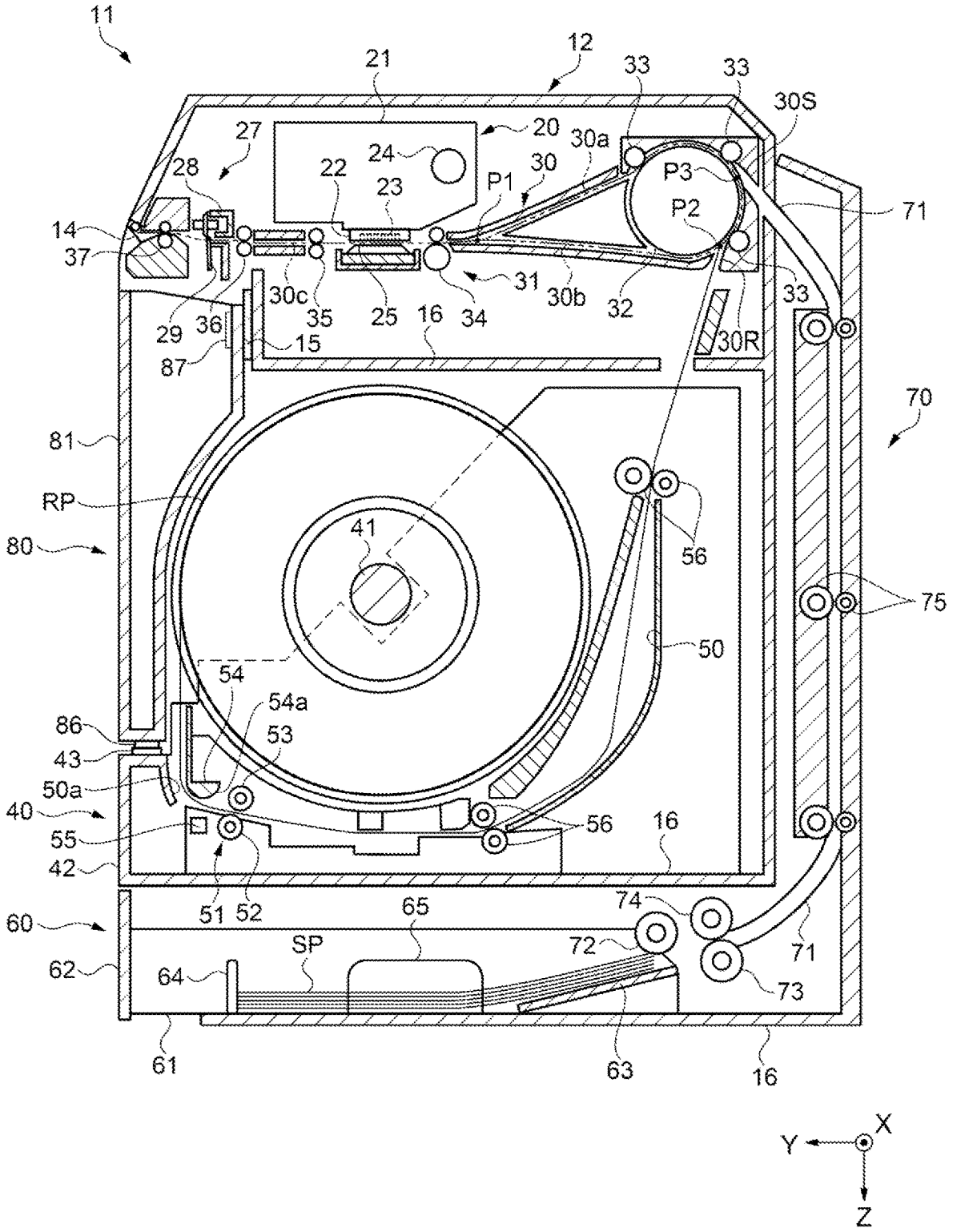
FIG. 3 is a cross-sectional view schematically illustrating an internal configuration of a printing apparatus.

As illustrated in FIGS. 1 to 3, the printing apparatus 11 includes a housing 12 of a rectangular parallelepiped shape and a main body frame 16 that supports portions of the printing apparatus 11. Inside the housing 12, there are provided a roll paper accommodating unit 40 configured to accommodate roll paper RP that is a printing medium, a single sheet paper accommodating unit 60 configured to accommodate single sheet paper SP that is a printing medium other than the roll paper RP, and a printing unit 20 configured to perform printing on the roll paper RP fed from the roll paper accommodating unit 40, and to perform printing on the single sheet paper SP that is fed from the single sheet paper accommodating unit 60. The roll paper accommodating unit 40 and the single sheet paper accommodating unit 60 are located downward of the printing unit 20 with respect to the vertical direction. In addition, a range in which the printing unit 20 is present on the Y axis overlaps a range in which the roll paper accommodating unit 40 is present on the Y axis and a range in which the single sheet paper accommodating unit 60 is present on the Y axis. In the printing apparatus 11 of to the embodiment, the single sheet paper accommodating unit 60 is located downward of the roll paper accommodating unit 40.

1-1. Printing Unit

The printing unit 20 includes a head 22 including a nozzle 23 configured to discharge ink toward the printing medium, a carriage 21 on which the head 22 is mounted, and a guide rail 24 disposed along the X axis. The printing unit 20 also includes a movement mechanism configured to reciprocally move the carriage 21 along the guide rail 24. A support unit 25 that supports the printing medium is provided at a position facing the head 22. The head 22 is configured to discharge ink while reciprocally moving in a paper width direction of the printing medium together with the carriage 21, to perform printing on the printing medium supported by the support unit 25. Note that, in the embodiment, a serial head type in which the head 22 reciprocally moves in the paper width direction is exemplified as the printing unit 20, and the printing unit 20 may be a line head type in which heads extend in the paper width direction and aligned in a fixed manner.

On an upper portion of the housing 12, there are provided a medium transport path 30 on which the printing medium is transported and a cutting unit 27 configured to cut the printing medium on which printing has been performed by the printing unit 20. The medium transport path 30 includes a feeding path 30*a* and an inverting path 30*b* provided upstream of the support unit 25, and an ejection path 30*c* provided downstream of the support unit 25. Moreover, the feeding path 30*a* includes a roll paper feeding path 30R on which roll paper is fed, and a single sheet paper feeding path 30S on which single sheet paper is fed.

The feeding path 30*a* is a path that connects from the roll paper feeding path 30R to the support unit 25. A roll paper joining point P2 that joins up with the roll paper feeding path 30R is provided upstream of the feeding path 30*a*. A branching point P1 that branches from the feeding path 30*a* when the printing medium is transported from downstream to upstream is provided downstream of the feeding path 30*a*. The inverting path 30*b* is a path that connects from the branching point P1 to the roll paper joining point P2. A single sheet paper joining point P3 that joins up with the single sheet paper feeding path 30S is provided between the roll paper joining point P2 and the branching point P1 on the feeding path 30*a*.

An ejection port 14 through which the printing medium on which printing has been performed is ejected is provided on a front face of the housing 12. Note that, in the embodiment, the front face of the housing 12 is a face that faces frontward of the housing 12. The ejection path 30*c* is a path that connects from the support unit 25 to the ejection port 14. The cutting unit 27 configured to cut the printing medium on which printing has been performed by the printing unit 20 is provided midway on the ejection path 30*c*. The cutting unit 27 includes a movable blade 28 configured to reciprocally move along the X axis that coincides with the paper width direction of the printing medium, and a fixed blade 29 that extends in the paper width direction to be fixed. The movable blade 28 is provided upward of the ejection path 30*c*, and the fixed blade 29 is provided downward of the ejection path 30*c*. The movable blade 28, by moving in the paper width direction while abutting against the fixed blade 29, cuts the roll paper RP, a margin section, and the like that are unwound from a rolled state, for example. There is provided, downward of the cutting unit 27, a cutting waste accommodating unit 80 configured to accommodate cutting waste generated by the cutting of the cutting unit 27.

The medium transport path 30 is provided with a transport unit 31 that transports the printing medium fed onto the medium transport path 30. The transport unit 31 includes, in the order from upstream on the feeding path 30*a*, an intermediate roller 32, a plurality of driven rollers 33 provided on an outer circumference of the intermediate roller 32, and an upstream transport roller pair 34. The driven roller 33, which is rotatably provided, is driven to rotate pinching the printing medium together with the intermediate roller 32. The transport unit 31 includes, in the order from upstream on the ejection path 30*c*, a downstream transport roller pair 35, a first roller pair 36, and a second roller pair 37. The first roller pair 36 is located upstream of the cutting unit 27, and the second roller pair 37 is located downstream of the cutting unit 27.

The intermediate roller 32, the driven roller 33, the upstream transport roller pair 34, the downstream transport roller pair 35, the first roller pair 36, and the second roller pair 37 rotate in a state of pinching the printing medium together to transport the printing medium. As a result of the transport unit 31 being driven forward, the printing medium is transported to a positive side of the Y axis, that is, from upstream to downstream. As a result of the transport unit 31 being driven reverse, the printing medium is transported to a negative side of the Y axis, that is, from downstream to upstream.

The printing apparatus 11 causes, while forward driving the transport unit 31 to transport the printing medium from upstream to downstream, the printing unit 20 to discharge ink onto the printing medium located at the support unit 25, to perform printing on a first surface of the printing medium. The printing apparatus 11 is configured to perform printing on a second surface that is a back surface of the first surface of the printing medium. The printing apparatus 11 reverse drives the transport unit 31 to transport, from downstream to upstream, the printing medium having the first surface on which printing has been performed. The printing medium reaches, from the branching point P1, upstream of the feeding path 30*a* via the inverting path 30*b*. The printing apparatus 11 forward drives the transport unit 31 again to cause the printing medium to rotate once around the outer circumference of the intermediate roller 32, to thus reverse the frontside and backside of the printing medium. The printing apparatus 11 causes, while transporting the printing medium from upstream to downstream, the printing unit 20 to discharge ink onto the printing medium located at the support unit 25, to perform printing on the second surface of the printing medium. This allows the printing to be performed on both of the surfaces of the printing medium. Note that when the printing medium is the roll paper RP that is unwound from the rolled state, printing is performed on the back surface of the printing medium that has been cut into single sheet paper by the cutting unit 27 after printing is performed on the front surface.

1-2. Roll Paper Accommodating Unit

As illustrated in FIG. 3, the roll paper accommodating unit 40 is provided, inside the housing, downward of the printing unit 20 with respect to the vertical direction. Further, in the Y axis direction, the range in which the roll paper accommodating unit 40 is present overlaps the range in which the printing unit 20 is present. The roll paper accommodating unit 40 includes, at a lower portion of a front face of the roll paper accommodating unit 40, a front plate portion 42 that forms a part of the housing 12. In the roll paper accommodating unit 40, the roll paper RP is rotatably supported via a support shaft 41 extending in the X direction of the housing 12. That is, the roll paper RP is supported by the roll paper accommodating unit 40 in a manner rotatable, together with the support shaft 41, about the support shaft 41 serving as a center of the rotation.

The support shaft 41 is configured to be rotatably driven in both of forward and reverse directions. The roll paper RP is rotatably driven, via the support shaft 41, in both of forward and reverse directions. In addition, the roll paper accommodating unit 40 is provided with a roll paper transport path 50 for transporting the roll paper RP that is being unwound from a rolled state toward the roll paper feeding path 30R.

The roll paper transport path 50 extends from a frontside to a downside of the roll paper RP that is supported via the support shaft 41 to then be bent backward, and turns around a downside and a backside of the roll paper RP and proceeds upward to a position that is higher than the roll paper RP to extend up to the roll paper feeding path 30R.

The roll paper transport path 50 has a bent portion 50*a* that is bent substantially at a 90-degree angle at an upstream end portion of the roll paper transport path 50, that is, at a position diagonally downward of a front part of the roll paper RP with respect to the roll paper transport path 50. Further, a decal mechanism 51 for performing a decal for correcting a curling habit of the roll paper RP is provided immediately downstream of the bent portion 50*a* of the roll paper transport path 50.

The decal mechanism 51 includes a first roller 52, a second roller 53, a fixed curved surface portion 54 having a curved surface 54*a* that forms a part of the bent portion 50*a*, and a movement device 55 for moving the first roller 52. The first roller 52 is movably disposed downside of the second roller 53 and the fixed curved surface portion 54. The second roller 53 and the fixed curved surface portion 54 are arranged in a state of being fixedly located so as to be aligned with each other in a front-back direction along the Y axis with a predetermined interval therebetween. The roll paper RP is then transported downstream through between the first roller 52 and the fixed curved surface portion 54 and between the first roller 52 and the second roller 53.

In addition, the first roller 52 is moved, by the driving of the movement device 55, between a lease position at which the first roller 52 does not press the roll paper RP illustrated in FIG. 3 and a nip position at which the first roller 52 presses the roll paper RP to pinch the roll paper RP together with the second roller 53. Further, in a state where the first roller 52 is at the nip position, the roll paper RP having the curling habit is bent and decaled, while being guided by the fixed curved surface portion 54, in a direction in which the curling habit is corrected.

At this time, the first roller 52 is located, in the front-back direction, between the second roller 53 and the fixed curved surface portion 54, and the roll paper RP is located, in the front-back direction, between the first roller 52 and the fixed curved surface portion 54. In the embodiment, the second roller 53 is configured by a driving roller that is driven by a motor disposed inside the housing 12, and the first roller 52 is configured by a driven roller that is driven to rotate by a rotational driving force of the second roller 53 being transmitted via the roll paper RP when the first roller 52 is at the nip position.

A roll paper transport roller pair 56 that impart a transport force to the roll paper RP are provided downstream, on the roll paper transport path 50, of the decal mechanism 51 at an appropriate interval. The roll paper transport roller pair 56 are rotatably driven to transport the roll paper RP onto the roll paper feeding path 30R.

The roll paper accommodating unit 40 is supported by the main body frame 16. The roll paper accommodating unit 40, when housing the roll paper RP, is opened frontward of the printing apparatus 11 through an opening portion 13 formed at a central portion of the front face of the housing 12. The roll paper accommodating unit 40 is movable in a manner drawable frontward of the printing apparatus 11 with respect to the main body frame 16. That is, the roll paper accommodating unit 40 is movable to a side at which the printing medium is ejected through the ejection port 14 with respect to the printing apparatus 11. Note that, as illustrated in FIG. 2, a movement range in which the roll paper accommodating unit 40 is movable has a length of L1.

As such, the printing apparatus 11 in which the roll paper accommodating unit 40 is located downward of the printing unit 20 can be reduced in installation area in the front-back direction, compared to a printing apparatus in which the roll paper accommodating unit is located backward of the printing unit. Also, in the printing apparatus in which the roll paper accommodating unit is located backward of the printing unit, because a space through which the roll paper is passed is necessary upward of the apparatus when the roll paper accommodating unit accommodates the roll paper, an installation area that is larger than a dimension of the apparatus is necessary in an up-down direction as well.

1-3. Cutting Waste Accommodating Unit

The cutting waste accommodating unit 80 is located frontward of the roll paper accommodating unit 40 and is removably provided with respect to the main body frame 16. The front plate portion 42 of the roll paper accommodating unit 40 of a drawable type is exposed at a downside of the cutting waste accommodating unit 80.

The cutting waste accommodating unit 80 includes an outer wall 81 that covers the opening portion 13 when the cutting waste accommodating unit 80 is attached to the housing 12, an inner wall 82 that faces the outer wall 81, and a side wall 83 that is jointed, at both ends in the X direction of the side wall 83, to the outer wall 81 and the inner wall 82. A bottom wall 84 is provided at a lower end portion of the cutting waste accommodating unit 80, and a receiving port 85 that receives cutting waste that is cut by the cutting unit 27 is provided at an upper end portion of the cutting waste accommodating unit 80. The inner wall 82 is curved in conformance with an outer circumference of the roll paper RP in the rolled state.

The cutting waste accommodating unit 80 includes a pair of engagement protrusions 86 that protrude downward at both end sides in the X direction of the bottom wall 84. On the other hand, the front plate portion 42 of the roll paper accommodating unit 40 includes a pair of support recesses 43 that open upward at positions on both end sides in the X direction. The cutting waste accommodating unit 80, when attached to the housing 12, is supported by the front plate portion 42 in a state where the engagement protrusions 86 are engaged with the support recesses 43.

The cutting waste accommodating unit 80 includes a pair of metal pieces 87 attached to both end sides, in the X direction, at an upper end portion of the inner wall 82. In addition, a pair of magnets 15 are attached to the main body frame 16 at positions facing the metal pieces 87 in a state where the cutting waste accommodating unit 80 is supported by the front plate portion 42.

When attaching the cutting waste accommodating unit 80 to the main body frame 16, the engagement protrusion 86 formed at a lower end side is engaged with the support recess 43 of the front plate portion 42, and then an upper end side of the cutting waste accommodating unit 80 is caused to be tilted toward a side of the main body frame 16 with the engagement protrusion 86 serving as a supporting point. The cutting waste accommodating unit 80 is then supported, via the engagement protrusion 86, by the front plate portion 42, and concurrently therewith, the metal pieces 87 are attracted to the magnets 15, thus maintaining an independent state of the receiving port 85 facing upward.

As illustrated in FIG. 1, when attaching the cutting waste accommodating unit 80, the opening portion 13 is covered by the outer wall 81 and the front plate portion 42. At this time, an outer face of the outer wall 81 is flush with an outer face of the front plate portion 42. That is, the outer wall 81 of the cutting waste accommodating unit 80 and the front plate portion 42 of the roll paper accommodating unit 40 serve as parts of the housing 12 of the printing apparatus 11. Also, as illustrated in FIG. 2, in a state where the roll paper accommodating unit 40 is opened frontward, the cutting waste accommodating unit 80 is removed from the main body frame 16.

1-4. Single Sheet Paper Accommodating Unit

As illustrated in FIG. 3, inside the housing 12, the single sheet paper accommodating unit 60 is provided downward of the roll paper accommodating unit 40 with respect to the vertical direction. The range in the Y axis direction in which the single sheet paper accommodating unit 60 is present overlaps the range in which the roll paper accommodating unit 40 is present. The single sheet paper accommodating unit 60 includes a front plate portion 62 that forms a part of the housing 12 on the front face of the single sheet paper accommodating unit 60. The single sheet paper accommodating unit 60 includes a tray 61 of a box shape in which single sheet paper SP is accommodated. The tray 61 includes a pair of edge guides 65 that are operated when positioning the single sheet paper SP in the width direction, a stopper 64 that is operated when positioning the single sheet paper SP in the front-back direction, and a hopper 63 that biases an end portion downstream of the single sheet paper SP accommodated in the tray 61 toward a pick-up roller 72.

The single sheet paper accommodating unit 60 is supported by the main body frame 16. The single sheet paper accommodating unit 60 is opened frontward of the printing apparatus 11 through an opening portion 17 formed at a lower portion of the front face of the housing 12 when housing the single sheet paper SP. The single sheet paper accommodating unit 60 is movable in a manner drawable frontward of the printing apparatus 11 with respect to the main body frame 16. As illustrated in FIG. 2, a movement range in which the single sheet paper accommodating unit 60 is movable has a length of L2 that is longer than a movement range of L1 in which the roll paper accommodating unit 40 moves. Also, as illustrated in FIG. 1, the cutting waste accommodating unit 80 avoids being located on a movement path on which the single sheet paper accommodating unit 60 moves, that is, frontward of the single sheet paper accommodating unit 60.

The single sheet paper accommodating unit 60 forms a part of a single sheet paper feed unit 70 that feeds the single sheet paper SP toward the printing unit 20. The single sheet paper feed unit 70 includes the single sheet paper accommodating unit 60, a single sheet paper transport path 71, the pick-up roller 72, a retarder roller 73, a separate roller 74, and the like.

The pick-up roller 72 is located upward of a downstream end portion of the single sheet paper SP accommodated in the single sheet paper accommodating unit 60. The pick-up roller 72 rotates in a state of being in contact with the single sheet paper SP to pick up the single sheet paper SP. The retarder roller 73 and the separate roller 74 are provided facing each other, in the up-down direction, downstream of the pick-up roller 72. The retarder roller 73 and the separate roller 74 rotate in a state of pinching the single sheet paper SP that is picked up from the single sheet paper accommodating unit 60 by the pick-up roller 72, to thus feed the single sheet paper SP toward the printing unit 20.

The separate roller 74 is a roller that comes into contact with the same surface as a surface of the single sheet paper SP with which the pick-up roller 72 is in contact, and the retarder roller 73 is a roller that comes into contact with a surface that is opposite to that surface. That is, the retarder roller 73 is located downward of the separate roller 74. Note that the retarder roller 73 is a roller that is driven to rotate in conjunction with the rotation of the separate roller 74. Also, the retarder roller 73 is configured such that the friction coefficient with respect to the single sheet paper SP is greater than that of the separate roller 74. The separate roller 74 and the retarder roller 73 then separate, one by one, the single sheet paper SP by the difference in the friction coefficients to transport the separated single sheet paper SP.

The single sheet paper transport path 71 is bent upward from the separate roller 74 and the retarder roller 73, and extends upward, behind the roll paper accommodating unit 40, to the single sheet paper feeding path 30S.

On the single sheet paper transport path 71, a single sheet paper transport roller pair 75 that impart a transport force to the single sheet paper SP are provided at an appropriate interval. The single sheet paper transport roller pair 75 are rotatably driven to transport the single sheet paper SP to the single sheet paper feeding path 30S.

As described above, the printing apparatus 11 according to the embodiment can achieve the following advantageous effects.

The printing apparatus 11 includes the roll paper accommodating unit 40 configured to accommodate the roll paper RP, and the single sheet paper accommodating unit 60 configured to accommodate the single sheet paper SP that is a printing medium other than the roll paper RP. The roll paper accommodating unit 40 and the single sheet paper accommodating unit 60 are located in the ranges overlapping, in the front-back direction of the printing apparatus 11, the range in which the printing unit 20 is present, and is located downward of the printing unit 20 with respect to the vertical direction, which makes a placement space for placing the printing medium at an outside of the apparatus unnecessary. Because the roll paper accommodating unit 40 and the single sheet paper accommodating unit 60 are opened frontward of the printing apparatus 11, which makes a work space for housing the printing medium at an upper side and left and right of the apparatus unnecessary. This allows the printing apparatus 11 to be installed in a narrow space.

Note that, in the embodiment, a configuration in which the single sheet paper accommodating unit 60 is provided downward of the roll paper accommodating unit 40 is exemplified, and the similar advantageous effects can be achieved even with a configuration in which a roll accommodating unit is provided downward of a single sheet paper accommodating unit.

Because the single sheet paper accommodating unit 60 is provided downward of the roll paper accommodating unit 40, the single sheet paper transport path 71 for feeding the single sheet paper to the printing unit 20 can be elongated. This allows the single sheet paper transport path 71 to be configured by a path having a small curvature, which enables to transport the single sheet paper SP in a suitable manner.

The single sheet paper accommodating unit 60, which is configured to move on the movement path on which the cutting waste accommodating unit 80 avoids being disposed, can be moved frontward of the printing apparatus 11 without removing the cutting waste accommodating unit 80. This improves a work efficiency when housing the single sheet paper SP in the single sheet paper accommodating unit 60.

In a state where the roll paper accommodating unit 40 is opened frontward, the cutting waste accommodating unit 80 is removed from the main body frame 16. The cutting waste accommodating unit 80 is removed when housing the roll paper RP in the roll paper accommodating unit 40, which prompts a user to discard cutting waste.

The single sheet paper accommodating unit 60 is movable further frontward than the movement range in which the roll paper accommodating unit 40 moves, which makes it possible to concurrently accommodate the roll paper RP and the single sheet paper SP.

What is claimed is:

1. A printing apparatus, comprising:

a roll paper accommodating unit configured to accommodate roll paper;

a single sheet paper accommodating unit configured to accommodate single sheet paper;

a printing unit configured to perform printing on the roll paper fed from the roll paper accommodating unit, and to perform printing on the single sheet paper fed from the single sheet paper accommodating unit;

a main body frame that supports the single sheet paper accommodating unit and the roll paper accommodating unit;

a first transport path that transports the single sheet paper from the single sheet accommodating unit;

a second transport path that transports the roll paper from the roll paper accommodating path;

a third transport path which connects to the first and second transport paths and transports the single sheet paper and the roll paper to the printing unit, the first and second transport paths connecting to the third transport path at an inverting roller;

a fourth transport path that transports the single sheet paper and the roll paper from the printing unit to the inverting roller, the fourth transport path branching from the third transport path at a branch point that is downstream of the inverting roller and upstream of the printing unit, the fourth transport path extending from the branch point to a first joining point where the second transport path contacts the inverse roller, and the first transport path contacting the inverse roller at a second joining point where the first and second transport paths connect, wherein a portion of the fourth transport path overlaps a portion of the third transport path in a vertical direction; and a fifth transport path that transports the single sheet paper and the roll paper from the printing unit to an ejection port, wherein the roll paper accommodating unit and the single sheet paper accommodating unit are located in ranges overlapping, in a front-back direction of the printing apparatus, a range in which the printing unit is present, and are located downward of the printing unit in the vertical direction, and the roll paper accommodating unit and the single sheet paper accommodating unit are movable frontward of the printing apparatus.

2. The printing apparatus according to claim 1, wherein the single sheet paper accommodating unit is located downward of the roll paper accommodating unit in the vertical direction.

3. The printing apparatus according to claim 1, wherein a cutting unit configured to cut the roll paper, and a cutting waste accommodating unit configured to accommodate cutting waste generated by cutting by the cutting unit, wherein the cutting waste accommodating unit is not located on a movement path of the single sheet paper accommodating unit so that the single sheet paper accommodating unit is movable frontward of the printing apparatus with respect to the main body frame.

4. The printing apparatus according to claim 1, wherein the roll paper accommodating unit is configured to be withdrawn frontward of the printing apparatus with respect to the main body frame, by removal, from the main body frame, of a cutting waste accommodating unit located on a movement path of the roll paper accommodating unit.

5. The printing apparatus according to claim 1, wherein the single sheet paper accommodating unit is movable further frontward than a frontward movement range of the roll paper accommodating unit with respect to the main body frame.

* * * * *